US012091735B2

(12) United States Patent
Knaack et al.

(10) Patent No.: US 12,091,735 B2
(45) Date of Patent: Sep. 17, 2024

(54) METHOD OF MANUFACTURING AN Al—Mg—Mn ALLOY PLATE PRODUCT HAVING AN IMPROVED CORROSION RESISTANCE

(71) Applicant: ALERIS ROLLED PRODUCTS GERMANY GMBH, Koblenz (DE)

(72) Inventors: Nele Mareike Knaack, Koblenz (DE); Bernd Jacoby, Koblenz (DE); Achim Bürger, Koblenz (DE); Otmar Martin Müller, Koblenz (DE)

(73) Assignee: NOVELIS KOBLENZ GMBH, Koblenz (DE)

( * ) Notice: Subject to any disclaimer, the term of this patent is extended or adjusted under 35 U.S.C. 154(b) by 751 days.

(21) Appl. No.: 16/973,920

(22) PCT Filed: Jun. 3, 2019

(86) PCT No.: PCT/EP2019/064313

§ 371 (c)(1),
(2) Date: Dec. 10, 2020

(87) PCT Pub. No.: WO2019/238449

PCT Pub. Date: Dec. 19, 2019

(65) Prior Publication Data

US 2021/0269906 A1 Sep. 2, 2021

(30) Foreign Application Priority Data

Jun. 11, 2018 (EP) ..... 18176931

(51) Int. Cl.
*C22F 1/047* (2006.01)
*C22C 21/08* (2006.01)

(52) U.S. Cl.
CPC ..... *C22F 1/047* (2013.01); *C22C 21/08* (2013.01); *C22C 2202/00* (2013.01)

(58) Field of Classification Search
None
See application file for complete search history.

(56) References Cited

U.S. PATENT DOCUMENTS

| | | | | |
|---|---|---|---|---|
| 2015/0152537 | A1* | 6/2015 | Engler | C22C 21/08 148/552 |
| 2015/0159251 | A1* | 6/2015 | Hentschel | C22C 21/06 148/552 |
| 2018/0112297 | A1* | 4/2018 | Engler | C22C 21/06 |
| 2018/0291482 | A1* | 10/2018 | Kang | C22C 21/06 |

FOREIGN PATENT DOCUMENTS

| | | |
|---|---|---|
| CN | 106244872 | 12/2016 |
| EP | 0892858 | 1/1999 |
| EP | 1078109 | 2/2001 |
| JP | 08283923 | 10/1996 |
| JP | 11507102 | 6/1999 |
| JP | 2006283138 | 10/2006 |
| WO | WO-2008/098743 A1 * | 8/2008 |

OTHER PUBLICATIONS

English Translation of CN 106244872 A (originally published Dec. 21, 2016), obtained from PE2E search.*

Huang et al., "Effect of Homogenization on the Corrosion Behavior of 5083-H321 Aluminum Alloy", Journal of Alloys and Compounds, vol. 673, Mar. 3, 2016, pp. 73-79.

International Application No. PCT/EP2019/064313, International Search Report and Written Opinion Received, mailed Jul. 15, 2019, 10 pages.

Zazi et al., "Dissolution of Ag/AgCl Reference Electrode and Deposition of Silver Onto the Surface of 5083 H321 Aluminum Alloy, During Corrosion in 3 wt % NaC1 Solution at Rest Potential", Protection of Metals and Physical Chemistry of Surfaces, vol. 53, 2017, pp. 1114-1119.

Australian Application No. 2019284797 , "Notice of Acceptance", Oct. 22, 2021, 3 pages.

European Application No. 19729219.6 , Office Action, Mailed on Mar. 4, 2022, 4 pages.

Japanese Application No. 2021-517906 , Office Action, Mailed on Jan. 5, 2022, 13 pages.

Japanese Application No. 2021-517906 , "Notice of Decision to Grant", Aug. 2, 2022, 6 pages.

(Continued)

*Primary Examiner* — George Wyszomierski

(74) *Attorney, Agent, or Firm* — Kilpatrick Townsend & Stockton LLP

(57) ABSTRACT

The invention relates to a method of manufacturing an Al—Mg—Mn aluminium alloy plate product having a final gauge in the range of 3 mm or more, the method comprising the steps of: (a) providing a rolling feedstock material of an aluminium alloy having a composition comprising of Mg 3.5-5.3% and Mn 0.20-1.2%; (b) preheating and/or homogenisation; (c) hot rolling of the rolling feedstock to a rolled final gauge; (d) a first cold working operation selected from the group consisting of (i) stretching in a range of 3% to 20%, and (ii) cold rolling with a cold rolling reduction in a range of 5% to 25%; (c) annealing of the cold worked plate at a temperature in a range of 200° C. to 280° C.; (f) a second cold working operation selected from the group consisting of (i) stretching in a range of 0.4% to 3%, and (ii) cold rolling with a cold rolling reduction in a range of 0.5% to 5%.

17 Claims, No Drawings

(56) References Cited

OTHER PUBLICATIONS

Korean Application No. 10-2021-7000325 , "Office Action", Jul. 11, 2022, 11 pages.
Korean Application No. 10-2021-7000325 , "Office Action", Jan. 29, 2023, 7 pages.
Korean Application No. 10-2021-7000325 , "Office Action", Apr. 21, 2023, 7 pages.
Australian Application No. 2019284797, First Examination Report, mailed May 25, 2021, 2 pages.
ASTM G 66-99 , "Standard Test Method for Visual Assessment of Exfoliation Corrosion Susceptibility of 5XXX Series Aluminum Alloys (ASSET Test)", ASTM International, 2013.
ASTM G67-13 , "Standard Test Method for Determining the Susceptibility to Intergranular Corrosion of 5XXX Series Aluminum Alloys by Mass Loss After Exposure to Nitric Acid (NAMLT Test)1", ASTM International, 2013.
Korean Application No. 10-2023-7020611 , "Office Action", Feb. 20, 2024, 11 pages.

* cited by examiner

METHOD OF MANUFACTURING AN Al—Mg—Mn ALLOY PLATE PRODUCT HAVING AN IMPROVED CORROSION RESISTANCE

FIELD OF THE INVENTION

The invention relates to a method of manufacturing an Al—Mg—Mn plate product having improved corrosion resistance. The plate product can be used amongst others for marine hull construction and other marine applications where frequent or constant direct contact with sea water is expected and for similar environments.

BACKGROUND OF THE INVENTION

Aluminium alloys like AA5083, AA5383 and AA5456 have been broadly used in the construction of marine vessels to meet the demand of reducing ship hull weight while considering high specific strength, corrosion resistance, and weldability. Aluminium alloys that contain high levels of magnesium are known to have high strength. However, aluminium alloys having high levels of magnesium are also known to be susceptible to intergranular corrosion (IGC) and stress corrosion cracking (SCC). A particular concern of these Al—Mg—Mn alloys is sensitization when highly anodic β-phase ($Al_3Mg_2$) is precipitated at grain boundaries especially in service exceeding about 80-200° C., leading to intergranular corrosion (IGC), exfoliation, and stress corrosion cracking (SCC).

It is an object of the invention to provide a method of manufacturing an Al—Mg—Mn alloy plate resulting in a plate product having a high mechanical strength and a good corrosion resistance both before and after a sensitization heat treatment.

DESCRIPTION OF THE INVENTION

As will be appreciated herein below, except as otherwise indicated, aluminium alloy and temper designations refer to the Aluminium Association designations in Aluminum Standards and Data and the Registration Records, as published by the Aluminium Association in 2016 and are well known to the persons skilled in the art.

For any description of alloy compositions or preferred alloy compositions, all references to percentages are by weight percent unless otherwise indicated.

The term "up to" and "up to about", as employed herein, explicitly includes, but is not limited to, the possibility of zero weight-percent of the particular alloying component to which it refers. For example, up to 0.1% Zn may include an alloy having no Zn.

This and other objects and further advantages are met or exceeded by the present invention providing a method of manufacturing an Al—Mg—Mn aluminium alloy plate product having a final gauge in the range of 3 mm or more, preferably 3 mm to 300 mm, preferably 3 mm to 120 mm, more preferably 4 mm to 90 mm, the method comprising the steps, in that order, of:

(a) providing a rolling feedstock material of an aluminium alloy having a composition comprising of, in wt. %,
Mg 3.5% to 5.3%
Mn 0.20% to 1.2%
Fe up to 0.4%
Si up to 0.4%
Cu up to 0.10%
Cr up to 0.25%

Zr up to 0.25%
Zn up to 0.2%
Ti up to 0.15%,
unavoidable impurities, typically each <0.05%, total <0.15%, and the balance aluminium;

(b) preheating and/or homogenisation;

(c) hot rolling of the rolling feedstock to a rolled final gauge in a range of 3 mm to 310 mm, preferably 3 mm to 130 mm, and more preferably 4 mm to 100 mm;

(d) a first cold working operation selected from the group consisting of (i) stretching in a range of 3% to 20%, and (ii) cold rolling with a cold rolling reduction in a range of 5% to 25%;

(e) following the first cold working operation an annealing heat-treatment of the plate at a temperature in a range of 200° C. to 280° C.; and (f) a second cold working operation selected from the group consisting of (i) stretching in a range of 0.4% to 3%, preferably 0.4% to less than 2%, and (ii) cold rolling with a cold rolling reduction in a range of 0.5% to 5%.

The method according to this invention provides Al—Mg—Mn alloy plate products having a desirable balance in strength and corrosion resistance both before and after a sensitization heat treatment (7 days@100° C.).

The Al—Mg—Mn alloy plate products are resistant to exfoliation corrosion. "Resistant to exfoliation corrosion" means that the aluminium alloy product passes ASTM Standard G66-99 (2013), entitled "Standard Test Method for Visual Assessment of Exfoliation Corrosion Susceptibility of 5XXX Series Aluminium Alloys (ASSET Test)". PA, PB, PC and PD indicate the results of the ASSET test, PA representing the best result. The plate products manufactured in accordance with the invention achieve a PB result or better.

The Al—Mg—Mn alloy plate products are also resistant to intergranular corrosion. "Resistant to intergranular corrosion" means that, both before and after the Al—Mg—Mn alloy has been sensitized (7 days@100° C.), the aluminium alloy plate product passes ASTM Standard G67-13, entitled "Standard Test Method for Determining the Susceptibility to Intergranular Corrosion of 5XXX Series Aluminium Alloys by Mass Loss After Exposure to Nitric Acid" (NAMLT Test)". If the measured mass loss per ASTM G67-13 is not greater than 15 mg/cm$^2$, then the sample is considered not susceptible to intergranular corrosion. If the mass loss is at least about than 25 mg/cm$^2$, then the sample is considered susceptible to intergranular corrosion. If the measured mass loss is between 15 mg/cm$^2$ and 25 mg/cm$^2$, then further checks are conducted by microscopy to determine the type and depth of attack, whereupon one skilled in the art may determine whether there is intergranular corrosion via the microscopy results. The plate products manufactured in accordance with the invention achieve a measured mass loss per ASTM G67-13 not greater than 15 mg/cm$^2$, both before and after age sensitized. "Sensitized" means that the aluminium alloy plate product has been annealed to a condition representative of at least 20 years of service life. For example, the aluminium alloy plate product may be continuously exposed to elevated temperature for several days (e.g., a temperature in the range 100° C. to 120° C. for a period of 7 days).

The Al—Mg—Mn aluminium alloy can be provided as an ingot or slab for fabrication into rolling feedstock using semi-continuous casting techniques regular in the art for cast products, e.g. DC-casting, EMC-casting, EMS-casting, and preferably having an ingot thickness in a range of about 300 mm or more, e.g. 400 mm, 500 mm or 600 mm. The rolling feedstock is preferably about 1,000 mm or more in width by about 3.5 meters or more in length. Such large ingots are preferred in practicing the invention especially in making large plate products for use in for example marine vessel construction. In another embodiment thinner gauge slabs resulting from continuous casting, e.g. belt casters or roll casters, can also be used to provide Al—Mg—Mn rolling feedstock, and having a thickness of up to about 40 mm, and can be used for the production of thinner gauge plate products in accordance with this invention.

After casting the rolling feedstock, in particular the thick as-cast ingot is commonly scalped to remove segregation zones near the cast surface of the cast ingot.

The aluminium alloy stock is preferably preheated and/or homogenized at a temperature of at least 480° C. prior to hot rolling in single or multiple steps. In order to avoid eutectic melting resulting in possible undesirable pore formation within the ingot, the temperature should not be too high, and should typically not exceed 535° C. The time at temperature for a large commercial ingot can be about 1 to 36 hours. A longer period, for example 48 hours or more, has no immediate adverse effect on the desired properties but is economically unattractive. When using a regular industrial scale furnace, the heating rate is typically in a range of about 30° C./hour to about 40° C./hour.

The alloy is hot rolled to reduce its thickness by at least about 40% of its initial thickness, for instance about 60% or 65% or more of its thickness when using large commercial starting rolling stock (for instance around 400 mm or more thickness) using for example a reversing hot mill which rolls the metal back and forth to squeeze its thickness down. Thus, the initial hot rolling can be done in increments using different rolling mills. It can also include conventional reheating procedures at around 500° C. between the rolling passes to replace lost heat.

It is an important feature of the invention that the rolled material at final hot rolled thickness is subsequently cold worked twice, preferably at ambient temperature, in separate cold working operations and an annealing heat treated between the two cold working operations. In a preferred embodiment, both the first and second cold working operations are by means of stretching. Stretching is defined as the permanent elongation in the direction of stretching, commonly in the L-direction of the subject plate product.

Following the hot rolling operation, the alloy plate product is cold worked by means of a first cold working operation selected from the group consisting of (i) stretching in a range of about 3% to about 20%, and (ii) cold rolling with a cold rolling reduction in a range of about 5% to about 25%. Although in a less preferred mode, the cold working steps can also be carried out in combination, for example a cold rolling operation followed by a stretching operation.

In a preferred embodiment of the first cold working operation at ambient temperature, it is performed by using a stretching apparatus, and no cold rolling operation is being performed. The stretching is in a range of about 3% to about 20%. The stretching can be performed in a single stretching operation. The stretching can be performed in two or more sequential stretching operations, e.g., two or three, in particular for the higher stretching degrees.

In a preferred embodiment plate products having a final gauge of more than 50 mm after the first and second cold working operation are preferably stretched in a range of about 5% to about 15%, more preferably of at least about 7%. And plate products having a final gauge of up to 50 mm after the first and second cold working operation are preferably stretched in a range of about 3% to about 16%, preferably by at least 5%, and preferably for not more than 12%.

Following the cold working operation, preferably by means of a stretching operation, the cold worked plate is subjected to an annealing heat treatment to dissolve substantially all β-phase particles that may have been formed in the previous processing steps, in a furnace at a set temperature in a range of about 200° C. to 280° C., preferably in a range of about 220° C. to 260° C., and more preferably in a range of about 230° C. to 250° C. followed by cooling. The skilled person knows that with increasing Mg-content in the aluminium alloy, the temperature to dissolve the β-phase particles also increases.

The time at the annealing temperature in is a range of 15 minutes to about 4 hours, preferably up to about 3 hours, and more preferably up to about 2 hours. Annealing temperatures above 280° C. or too long soaking times at the set annealing temperature are to be avoided in order to prevent (partial) recrystallisation of the microstructure adversely affecting the strength levels in the final plate product.

The aluminium alloy plate products realize resistance to stress corrosion cracking and intergranular corrosion as a result of, at least in part, due to the absence of a continuous film of β-phase particles at the grain boundaries. Aluminium alloy products are polycrystalline. A "grain" is a crystal of the polycrystalline structure of the aluminium alloy, and "grain boundaries" are the boundaries that connect the grains of the polycrystalline structure of the aluminium alloy, "β-phase" is $Al_3Mg_2$, and "a continuous film of β-phase" means that a continuous volume of β-phase particles is present at the majority of the grain boundaries. The continuity of the β-phase may be determined, for example, via microscopy at a suitable resolution (e.g., a magnification of at least 200×).

The cooling down from the set annealing temperature to about 200° C. should be done preferably at a cooling rate of not more than 10° C./hour, and preferably not more than 5° C./hour. The relative slow cooling rate is important for the precipitation of discontinuous β-phase particles at the grain boundaries and to avoid the precipitation of a continuous film of β-phase particles, both after cooling to ambient temperature and after the Al—Mg—Mn alloy has been sensitized.

The cooling down from about 200° C. to below about 85° C. is less critical and can be done at a higher cooling rate of for example more than 20° C./hour to minimize the coarsening of precipitates. The cooling down from about 85° C. to ambient temperature is not critical.

Alternatively, other heat treatment procedures can be performed in the temperature range of 200° C. to 280° C. resulting in a similar time@temperature equivalent to the heat treatment resulting from the cooling rates herein described. These heat treatments may comprise faster cooling rates when combined with intermediate soaking steps.

Next, the annealed and cooled plate product is subjected to a second cold working operation to increase the strength of the plate product and is selected from the group consisting of (i) stretching in a range of about 0.4% to about 3%, preferably about 0.4% to less than 2%, and (ii) cold rolling with a cold rolling reduction in a range of about 0.5% to about 5%, and preferably in a range of about 0.5% to about 4%. The cold rolling operation can be performed in the form of a skin pass.

In a preferred embodiment of the second cold working operation at ambient temperature, it is performed by using a stretching apparatus, and no cold rolling operation is being performed. The stretching is in a range of about 0.4% to about 3% of its length at the start of the second stretching operation, preferably about 0.4% to less than 2%, and more preferably in a range of about 0.5% to about 1.7%.

After the second stretching operation, the Al—Mg—Mn plate product is at a final gauge in the range of 3 mm to about 300 mm, preferably 3 mm to about 200 mm, more preferably about 3 mm to about 120 mm, and most preferably in the range of 4 mm to 90 mm.

Thereafter, the plate product can be edge trimmed and sawn or cut-to-length to final dimensions, stored, and shipped.

In a preferred embodiment, the final Al—Mg—Mn aluminium alloy plate product has an unrecrystallized microstructure, and more preferably a fully unrecrystallized microstructure, and providing the required balance of properties including strength and corrosion resistance. With "fully unrecrystallized" is meant that the degree of recrystallization of the microstructure is not more than about 25%, preferably not more than about 20%, and more preferably not more than 15%.

The aluminium alloy plate product according to the invention can be welded by means of all regular welding techniques such as MIG and friction stir welding. The aluminium plate can be welded using regular filler wires such as AA5183 or by modified filler wires having a higher Mg- and/or Mn-content.

In the aluminium alloy plate product manufactured in accordance with the method of the invention, the Mg-content should be in a range of about 3.5% to about 5.3% and forms the primary strengthening element of the aluminium alloy. A preferred lower-limit for the Mg-content is about 4.0%, and more preferably about 4.4%, and most preferably about 4.6%, to provide sufficient strength to the plate material. A preferred upper-limit for the Mg-content is about 5.1%, and more preferably about 4.95%. The corrosion resistance, in particular the resistance against intergranular corrosion, exfoliation corrosion and stress corrosion, deteriorates very fast at higher Mg levels.

The Mn-content should be in the range of about 0.20% to about 1.2% and is another essential alloying element. A preferred lower-limit for the Mn-content is about 0.35%, preferably about 0.5%, and more preferably about 0.6%. A preferred upper-limit for the Mn-content is about 1.05%, and more preferably about 1.0%, to provide a balance in strength and corrosion resistance.

To control the microstructure of the final product, next to the addition of Mn, it is preferred to have a purposive addition of either Cr or Zr each up to about 0.25% as dispersoid-forming elements.

A preferred addition of Cr is in a range of about 0.04% to 0.25%, and more preferably of about 0.06% to about 0.20%. A more preferred upper-limit for the Cr-content is about 0.15%. When Cr is added purposively, it is then preferred that the Zr level does not exceed 0.10%, and is preferably less than about 0.07%. And a preferred lower-limit content for the Zr level is about 0.01%, and preferably about 0.02%.

Iron (Fe) is a common impurity and can be present in a range of up to about 0.4% and preferably is kept to a maximum of about 0.25%. A typical preferred iron level would be in the range of up to 0.20%.

Silicon (Si) is a common impurity and can be present in a range of up to about 0.4% and preferably is kept to a maximum of about 0.25%. A typical preferred Si level would be in the range of up to 0.20%.

As the corrosion resistance is a very critical engineering property in the plate material when used in a marine environment, it is preferred to maintain the copper (Cu) at a low level of 0.10% or less, and preferably at a level of 0.08% or less, and more preferably at a level of 0.06% or less, as it may have in particular an adverse effect on the ASSET test results.

Zinc (Zn) is a common impurity and can be present in a range of up to about 0.2%, and preferably is kept to a maximum of about 0.15%, and more preferably at a maximum of about 0.10%, as it may have in particular an adverse effect on the NAMLT test results.

Ti is important as a grain refiner during solidification of both ingots and welded joints produced using the alloy product of the invention. Ti levels should not exceed about 0.15%, and the preferred range for Ti is about 0.005% to 0.1%. Ti can be added as a sole element or as is known in the art with either boron or carbon serving as a casting aid, for grain size control.

In an embodiment of the invention, the Al—Mg—Mn aluminium alloy consists of, in wt. %: Mg 3.5% to 5.3%, Mn 0.20% to 1.2%, Fe up to 0.4%, Si up to 0.4%, Cu up to 0.10%, Cr up to 0.25%, Zr up to 0.25%, Zn up to 0.2%, Ti up to 0.15%, unavoidable impurities each <0.05%, total <0.15%, balance aluminium; and with preferred narrower compositional ranges as herein described and claimed.

The method according to this invention enables the production of Al—Mg—Mn plate products at a final gauge of up to 40 mm and having a composition as herein described and claimed and having a tensile yield strength in the L-direction of at least 215 MPa, preferably of at least 220 MPa, and in the best examples of more than 225 MPa. The ultimate tensile strength in the L-direction is at least 315 MPa, and preferably at least 320 MPa, and in the best examples of more than 330 MPa. The elongation at fracture (A5×) in the L-direction is at least 12%. These mechanical properties are measured in accordance with ASTM B557.

The method according to this invention enables the production of Al—Mg—Mn plate products at a final gauge of 40 mm to 90 mm and having a composition as herein described and claimed and having a tensile yield strength in the L-direction of at least 200 MPa, preferably of at least 210 MPa. The ultimate tensile strength in the L-direction is at least 290 MPa, and preferably at least 300 MPa. The elongation at fracture (A5×) in the L-direction is at least 12%. These mechanical properties are measured in accordance with ASTM B557.

The Al—Mg—Mn plate material obtained by the method according to this invention is an ideal candidate for use in a marine vehicle.

The method according to the invention can be applied also for the manufacturing of extruded sections having an aluminium alloy composition as herein described and claimed, and providing also a desirable balance in strength (e.g., tensile yield strength in the L-direction of at least 190 MPa, preferably at least 200 MPa, and a tensile strength in the L-direction of at least 310 MPa, and preferably of at least 325 MPa) and corrosion resistance both before and after a sensitization heat treatment (e.g., 7 days@100° C.). The extruded Al—Mg—Mn alloy profiles or sections are resistant to exfoliation corrosion when measured according to the earlier referenced ASTM Standard G66-99 (2013). The extruded Al—Mg—Mn alloy profiles or sections are resistant to intergranular corrosion when measured according to the earlier referenced ASTM Standard G67-13. The method comprises the steps, in that order, of:

(a) providing an extrusion ingot, e.g. by means of DC-casting, of an aluminium alloy as herein described and claimed;

(b) preheating and/or homogenisation of the extrusion ingot; preferably at temperature and times similar as for the rolling feedstock;

(c) hot extruding the ingot into an extruded profile having a section or wall thickness in a range of 2 mm to about 20 mm, preferably 2 mm to about 15 mm; the billet temperature at the start of the extrusion process is typically in a range of about 425° C. to about 500° C.;

(d) a first stretching operation in a range of about 3% to 20%, preferably about 3% to 15%, and more preferably about 3% to 10%;

(e) annealing of the extruded and stretched profile at a temperature in a range of about 200° C. to 280° C., and with preferred temperatures and soaking times and cooling procedures as for the rolling feedstock;

(f) a second stretching operation in a range of about 0.4% to 5%, preferably about 0.4% to 3%, and more preferably about 0.4% to 1.8%.

The invention is not limited to the embodiments described before, and which may be varied widely within the scope of the invention as defined by the appending claims.

The invention claimed is:

1. A method of manufacturing an Al—Mg—Mn aluminium alloy plate product having a final gauge in a range of 3 mm or more, the method comprising the steps of:

(a) providing a rolling feedstock material of an aluminium alloy having a composition comprising of, in wt. %, Mg 3.5% to 5.3%
Mn 0.20% to 1.2%
Fe up to 0.4%
Si up to 0.4%
Cu up to 0.10%
Cr up to 0.25%
Zr up to 0.25%
Zn up to 0.2%
Ti up to 0.15%,
unavoidable impurities and the balance aluminium;

(b) preheating and/or homogenisation;

(c) hot rolling of the rolling feedstock to a rolled final gauge in a range of 3 mm to 310 mm;

(d) a first cold working operation selected from the group consisting of (i) stretching in a range of 3% to 20%, and (ii) cold rolling with a cold rolling reduction in a range of 5% to 25%, to produce a cold worked plate;

(e) annealing of the cold worked plate at an annealing temperature in a range of 200° C. to 280° C.;

(f) cooling the annealed plate from the annealing temperature to a temperature of about 200° C. at a rate of not more than 10° C. per hour, cooling from the temperature of about 200° C. to a temperature below about 85° C. at a higher cooling rate, and then further cooling the annealed plate to ambient temperature; and (g) a second cold working operation selected from the group consisting of (i) stretching in a range of 0.4% to 3%, and (ii) cold rolling with a cold rolling reduction in a range of 0.5% to 5%, wherein the Al—Mg—Mn aluminium alloy plate product has a mass loss less than 25 mg/cm$^2$, as tested per ASTM G67-13.

2. The method according to claim 1, further comprising sensitizing the Al—Mg—Mn aluminium alloy plate product, wherein the Al—Mg—Mn aluminium alloy plate product before and after sensitization is PA or PB, as tested per ASTM G66-99.

3. The method according to claim 1, further comprising sensitizing the Al—Mg—Mn aluminium alloy plate product, wherein the Al—Mg—Mn aluminium alloy plate product is free of a continuous film of β-phase particles at the grain boundaries after said plate product has been sensitized.

4. The method according to claim 1, wherein the Al—Mg—Mn aluminium alloy plate product has a final gauge in a range of 3 mm to 120 mm.

5. The method according to claim 1, wherein during step (e) the annealing is performed in a temperature in the range of 220° C. to 260° C.

6. The method according to claim 1, wherein the first cold working operation consists of stretching in a range of 3% to 20%.

7. The method according to claim 1, wherein the second cold working operation consists of stretching in a range of 0.4% to 3%.

8. The method according to claim 1, wherein the aluminium alloy has a Mn-content of at most 1.05%.

9. The method according to claim 1, wherein the aluminium alloy has a Mg-content of at least 4.0%.

10. The method according to claim 1, wherein the aluminium alloy has a Cr-content in a range of 0.04% to 0.25%.

11. The method according to claim 1, wherein the aluminium alloy has a Zn-content of up to 0.15%.

12. The method according to claim 1, wherein the Al—Mg—Mn aluminium alloy plate product has an unrecrystallized microstructure.

13. The method according to claim 1, wherein the Al—Mg—Mn aluminium alloy plate product has a tensile yield strength of at least 200 MPa.

14. The method according to claim 1, wherein the Al—Mg—Mn aluminium alloy plate product has an ultimate tensile strength of at least 290 MPa.

15. A marine vehicle comprising at least one aluminium plate obtained by the method according to claim 1.

16. A ship hull comprising an aluminium plate obtained by the method according to claim 1.

17. The method according to claim 1, wherein during step (f) the cooling from the annealing temperature to the temperature of about 200° C. is at a cooling rate of not more than 5° C. per hour.

* * * * *